US009243528B2

(12) United States Patent
Skoog

(10) Patent No.: US 9,243,528 B2
(45) Date of Patent: Jan. 26, 2016

(54) DEVICE AND METHOD FOR CLEANING CRANKCASE GAS

(75) Inventor: Jan Skoog, Skogås (SE)

(73) Assignee: ALFA LAVAL CORPORATE AB, Lund (SE)

( * ) Notice: Subject to any disclaimer, the term of this patent is extended or adjusted under 35 U.S.C. 154(b) by 20 days.

(21) Appl. No.: 13/823,167

(22) PCT Filed: Sep. 15, 2011

(86) PCT No.: PCT/EP2011/065980

§ 371 (c)(1), (2), (4) Date: May 23, 2013

(87) PCT Pub. No.: WO2012/035089

PCT Pub. Date: Mar. 22, 2012

(65) Prior Publication Data

US 2013/0233290 A1 Sep. 12, 2013

(30) Foreign Application Priority Data

Sep. 15, 2010 (EP) ..... 10176868

(51) Int. Cl.
*B01D 45/12* (2006.01)
*B01D 45/14* (2006.01)
(Continued)

(52) U.S. Cl.
CPC ..... *F01M 13/04* (2013.01); *F01M 2013/0005* (2013.01); *F01M 2013/0044* (2013.01); *F01M 2013/0422* (2013.01)

(58) Field of Classification Search
CPC ..... F01M 13/04; F01M 2013/0422; F01M 2013/0438; F01M 13/00; F01M 2013/0494; F01M 13/0011; F01M 13/023; F01M 2013/0427; B04B 5/005
USPC ..... 123/572, 573, 574, 41.86; 55/438; 96/400, 402
See application file for complete search history.

(56) References Cited

U.S. PATENT DOCUMENTS 2,029,216 A * 1/1936 Barker ..... 123/41.86
5,536,289 A 7/1996 Spies et al.
(Continued)

FOREIGN PATENT DOCUMENTS

DE 10044615 A1 4/2002
DE 10044922 A1 4/2002
(Continued)

OTHER PUBLICATIONS

DE20302824, Jul. 2004, Hengst GMBH & CO KG—Translation.*

*Primary Examiner* — John Kwon
*Assistant Examiner* — Tea Holbrook
(74) *Attorney, Agent, or Firm* — MKG, LLC

(57) ABSTRACT

A device for cleaning of crankcase gas including a centrifugal separator having a housing and a separation chamber in which a rotor is arranged. The separator is connected to a gas inlet for conducting crankcase gas from the crankcase to the centrifugal separator and a gas outlet for conducting the cleaned gas from the separator. A motor is arranged to rotate the centrifugal rotor. A sensor is provided for detection of a parameter and is arranged to communicate with the control equipment. The control equipment is operatively connected to a valve for adjusting the flow of gas through the centrifugal separator. The control equipment is arranged to change the position of the valve in response to a detected change of the parameter such that the gas pressure in the crankcase is maintained at a predetermined value.

15 Claims, 2 Drawing Sheets

(51) Int. Cl.

| | |
|---|---|
| ***F01M 13/04*** | (2006.01) |
| *F01M 13/00* | (2006.01) |

(56) References Cited

U.S. PATENT DOCUMENTS

| | | | | |
|---|---|---|---|---|
| 5,792,949 | A * | 8/1998 | Hewelt et al. | 73/114.01 |
| 6,536,211 | B1 * | 3/2003 | Borgstrom et al. | 60/311 |
| 6,709,477 | B1 * | 3/2004 | Håkansson et al. | 55/401 |
| 6,821,319 | B1 | 11/2004 | Moberg et al. | |
| 7,159,582 | B2 * | 1/2007 | Nakajima et al. | 123/572 |
| 2001/0047801 | A1 * | 12/2001 | Baeuerle et al. | 123/574 |
| 2003/0073358 | A1 * | 4/2003 | Dagenais et al. | 440/88 F |
| 2004/0040442 | A1 * | 3/2004 | Franzen | B01D 45/14 95/270 |
| 2004/0112346 | A1 * | 6/2004 | Ahlborn | F01M 13/021 123/572 |
| 2005/0022795 | A1 * | 2/2005 | Beyer et al. | 123/516 |
| 2005/0268884 | A1 * | 12/2005 | Yokoyama | 123/299 |
| 2006/0048761 | A1 * | 3/2006 | Ekeroth | B01D 45/14 123/572 |
| 2009/0223496 | A1 * | 9/2009 | Borgstrom | B01D 45/14 123/573 |
| 2010/0011723 | A1 * | 1/2010 | Szepessy et al. | 55/438 |
| 2011/0011380 | A1 * | 1/2011 | Lagerlof et al. | 123/573 |
| 2011/0016957 | A1 * | 1/2011 | Haladyna et al. | 73/114.31 |
| 2011/0180052 | A1 * | 7/2011 | Schwandt | F01M 13/04 123/573 |
| 2012/0174544 | A1 * | 7/2012 | Tornblom et al. | 55/438 |
| 2013/0167816 | A1 * | 7/2013 | Dawar et al. | 123/573 |

FOREIGN PATENT DOCUMENTS

| | | | | |
|---|---|---|---|---|
| DE | 20302824 | U1 * | 7/2004 | F01M 13/14 |
| DE | 102004061938 | B3 | 6/2006 | |
| EP | 1532353 | B1 | 11/2009 | |
| JP | 2005-42698 | A | 2/2005 | |
| JP | 2005-530096 | A | 10/2005 | |
| JP | 2008-522079 | A | 6/2008 | |
| SE | WO 2004001200 | A1 * | 12/2003 | B01D 45/14 |
| WO | 0244530 | A1 | 6/2002 | |
| WO | 2004001200 | A1 | 12/2003 | |
| WO | 2005047661 | A1 | 5/2005 | |
| WO | 2006057597 | A1 | 6/2006 | |
| WO | 2007071373 | A2 | 6/2007 | |
| WO | 2010008342 | A1 | 1/2010 | |

* cited by examiner

DEVICE AND METHOD FOR CLEANING CRANKCASE GAS

TECHNICAL FIELD

The present invention relates to a device for cleaning of crankcase gas being produced during operation of an internal combustion engine, the device includes a centrifugal separator comprising a housing delimiting a separation chamber in which a centrifugal rotor is arranged for cleaning of the crankcase gas. The centrifugal separator is connected to a gas inlet for conducting a flow of crankcase gas from the crankcase to the centrifugal separator and a gas outlet for conducting the flow of gas from the centrifugal separator. A motor is arranged for the rotation of the centrifugal rotor, the motor is arranged with control equipment for changing the rotational speed of the motor and thereby of the centrifugal rotor. The device further comprises a sensor for detection of a parameter, the magnitude of which is related to a gas pressure in the crankcase, the sensor being arranged to communicate with the control equipment of the motor.

BACKGROUND

One problem in connection with cleaning of crankcase gases in this manner is to maintain a desired gas pressure in the crankcase. A solution to this problem is disclosed in EP1532353 B1 which describes the initially defined device in which the centrifugal rotor is arranged by its rotation to suck crankcase gas from the crankcase to the centrifugal separator, wherein the control equipment is arranged to change the rotational speed of the centrifugal rotor in response to a sensed change of said parameter in a way such that the gas pressure in the crankcase is maintained at a predetermined value, or at a predetermined pressure interval, during the operation of the combustion engine. Accordingly, the known device maintains a desired gas pressure within the crankcase by changing the rotational speed of the centrifugal rotor. However, reducing the rotational speed of the centrifugal rotor will also reduce the separating efficiency of the centrifugal rotor.

SUMMARY

One object of the invention is to provide a device and method for maintaining both a desired gas pressure in the crankcase and a separating efficiency of a centrifugal separator.

This object is achieved by the initially defined device which includes control equipment which is operatively connected to a valve which is arranged to adjust the flow of gas through the centrifugal separator, wherein the control equipment is arranged to change the position of the valve in response to a detected change of said parameter in a way such that the gas pressure in the crankcase is maintained at a predetermined value, or at a predetermined pressure interval, during operation of the combustion engine.

Consequently, the desired gas pressure in the crankcase is controlled by the position of the valve, whereby the rotational speed of the centrifugal rotor and thereby the separating efficiency of the centrifugal separator may be maintained. If the sensed parameter indicates an increased gas pressure in the crankcase, the control equipment simply changes the position of the valve to a more open position and vice versa. The flow of gas may be adjusted with the valve placed in the gas inlet or the gas outlet of the device. In the gas outlet almost all of the contaminants have been separated from the gas by the downstream located centrifugal rotor. Hence, the gas outlet would preferably be chosen if the valve for example requires a clean environment to work properly.

In one embodiment, the rotational speed of the centrifugal rotor is changed to control the gas pressure in the crankcase, i.e. maintaining the gas pressure in the crankcase by changing both the position of the valve and the rotational speed of the centrifugal rotor. In fact, according to an embodiment of the invention, the control equipment is arranged to change both the position of the valve and the rotational speed of the centrifugal rotor in a way such that the gas pressure in the crankcase is maintained at the predetermined value, or at the predetermined pressure interval, during the operation of the combustion engine. Hence, this provides versatility, both in the combined ways of maintaining the desired gas pressure and in the possibility of changing the separating efficiency.

In a further embodiment of the invention the control equipment is arranged to prioritize the change of the valve position instead of changing the rotational speed of the centrifugal rotor to maintain the gas pressure in the crankcase during operation of the combustion engine. It is advantageous to keep high speed rotation of the centrifugal rotor, so that a high separating efficiency is achieved. Accordingly, the gas pressure in the crankcase is primarily maintained during "normal" operating conditions of the combustion engine by changing the valve position only. In special operating conditions it would however also change the centrifugal rotor speed in order to maintain the gas pressure. For instance, such a special operating condition may occur during exceptionally high loads and/or speeds of the combustion engine. This yields great amounts of blow-by or crankcase gas which in turn increases the gas pressure significantly. In these special situations it may not be enough to simply change valve position to control the gas pressure. Another special operating condition may for instance arise during an engine start up and/or shut down procedure at which the rotational speed of the centrifugal rotor could also be adapted to maintain the gas pressure.

Hence, during extreme operational states of the combustion engine, it may not be possible to maintain the desired gas pressure by simply changing the position of the valve. In an embodiment of the invention the centrifugal rotor is arranged by its rotation to suck crankcase gas from the crankcase to the centrifugal separator. If the sensed parameter indicates a drastic increase in gas pressure, it could be necessary to change the valve position to a completely open position, and further increase the rotational speed of the centrifugal rotor to maintain the desired gas pressure in the crankcase. Increasing the rotational speed will furthermore increase the separating efficiency or capacity of the centrifugal separator to clean the increased amount of crankcase gas in the crankcase.

In other cases, the circumstances may put higher or lower demands on the separating efficiency of the centrifugal separator, wherein the rotational speed of the centrifugal rotor could be changed. For example, onboard a vehicle the available power is limited, wherein the distribution of power to critical sub-units of the vehicle will be prioritized. In such a case, the power consumption of the centrifugal separator may be reduced by decreasing the rotational speed of the centrifugal rotor. However, this will also reduce the separating efficiency and the pumping action of the centrifugal rotor, making it necessary to adjust the valve position in order to maintain the desired gas pressure in the crankcase.

In a further embodiment of the invention the centrifugal rotor comprises a plurality of separation discs. The rotor would hereby preferably include a stack of truncated conical separation discs. At present this constitutes one of the most efficient crankcase gas separators, i.e. the centrifugal rotor having the so called conical disc stack for cleaning the crankcase gas. This centrifugal rotor may provide a significant pumping effect. A centrifugal separator designed for large-sized engines in for instance power plants, diesel powered locomotives or ships could provide a pumping effect of about 700 $m^3$/h at a centrifugal rotor speed of 7 100 rpm if the valve is in a completely open state. In order to achieve as high separating efficiency as possible it is desirable to let this centrifugal rotor run at such high speeds at all times. By using the valve adjustment in combination with the separation discs of the centrifugal rotor rotating at such (constant) high speed, it is possible to achieve an extremely efficient separation, while the gas pressure is maintained by changing the valve position. The separating efficiency is even increased if the centrifugal rotor speed is maintained and the valve position is changed towards the closed position when compensating for reduced amounts of generated crankcase gas. The separating efficiency is increased because a reduced flow of crankcase gas is conducted through the centrifugal separator, while the centrifugal rotor is spinning at the same high speed.

In connection with this, the centrifugal separator may be arranged as a so called counter-current separator or concurrent separator. In general terms the centrifugal rotor will also work as a kind of centrifugal pump or fan. In counter-current separation, the crankcase gas is conducted into the centrifugal rotor from outside the periphery of the rotor towards a central part of the rotor. In this type of separator, the crankcase gas must be forced (by external pressure means) through the separator against the pumping action of the rotor. By increasing the rotational speed of the rotor, the pumping action or counter pressure of the rotor is increased, whereby an increased pressure in the crankcase is achieved and vice versa. However, in concurrent separation, the crankcase gas is conducted into the central part of the rotor and towards the outside periphery of the rotor. In this type of separator, the rotor pumps crankcase gas through the centrifugal separator. Hence, the centrifugal rotor is arranged by its rotation to suck crankcase gas from the crankcase to the centrifugal separator. By increasing the rotational speed of the rotor, the pumping action of the rotor increases, thereby decreasing the pressure in the crankcase and vice versa.

According to another embodiment of the invention the motor is an electrical motor with control equipment in the form of a variable frequency drive or VFD having an in-built regulator which is operatively connected to the valve. This provides a simple and effective way to control the pressure by using the VFD with its in-built regulator (e.g. a PID-regulator for controlling of the rotational speed of the rotor), to also adjust the gas pressure by changing the position of the valve.

According to yet another embodiment of the invention the control equipment includes a programmable logic controller or PLC. This PLC could be arranged with an input device for setting desired operational parameters of the device, such as the lower and upper limits of the desired pressure interval in the crankcase or lower and upper limits of the rotational speed of the centrifugal rotor or different modes of control (e.g. a mode of gas pressure control by only changing the valve position or by the combination of also changing the rotational speed of the centrifugal rotor).

The object of the present invention is also achieved by a corresponding method for cleaning crankcase gas according to the claims.

The present invention also relates to a use of the device for cleaning of crankcase gas from an internal combustion engine of a vehicle (such as a truck, a ship or a locomotive) or an internal combustion engine of a power plant.

BRIEF DESCRIPTION OF THE DRAWINGS

The invention will be further explained by a description of various embodiments in the following with reference to the accompanying drawings.

DETAILED DESCRIPTION OF VARIOUS EMBODIMENTS

Figure 1:
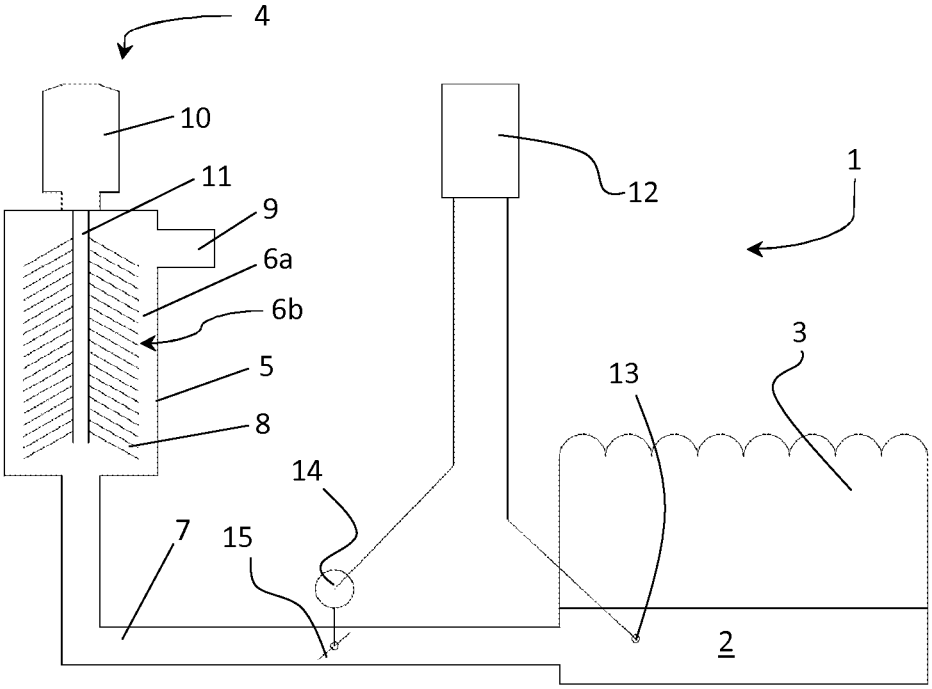
FIG. 1 is a schematic representation of a device according to a first embodiment of the invention.

FIG. 1 discloses a first embodiment of a device 1 for cleaning of crankcase gas being produced in a crankcase 2 during operation of an internal combustion engine 3. The combustion engine 3 could for example be a diesels engine onboard a locomotive or a truck. The device 1 includes a centrifugal separator 4 with a housing 5 delimiting a separation chamber 6*a* wherein a centrifugal rotor 6*b* is arranged for cleaning of said crankcase gas and arranged by its rotation to suck crankcase gas from the crankcase 2 to the centrifugal separator 4. Such a centrifugal separator which is arranged to suck or pump crankcase gas from the crankcase is described in more detail in for example EP 1532353 B1 and/or WO 2010/008342 A1. The housing 5 of the centrifugal separator 4 is connected to the crankcase 2 via a gas inlet 7 in the form of a conduit arranged between the centrifugal separator 4 and the crankcase 2. This gas inlet 7 is configured to conduct the crankcase gas to a central inlet chamber (not shown) formed in a center of the centrifugal rotor 6. The rotor 6 comprises a stack of truncated conical separation discs 8 arranged to bring the crankcase gas into rotation, whereby centrifugal forces will separate the contaminants from the crankcase gas. The housing 5 is provided with a gas outlet 9 in the form of a conduit for conducting the cleaned gas from the centrifugal separator 4. The gas outlet 9 is arranged to communicate with the separation chamber 6*a* which surrounds the centrifugal rotor 6*b*. This gas outlet 9 could be connected to an air inlet (not shown) of the internal combustion engine 3, whereby the cleaned gas is circulated back to the engine 3, or so-called closed crankcase ventilation (CCV). Alternatively, the gas outlet 9 could be arranged as an open outlet, whereby the gas outlet discharges the cleaned gases into the surrounding environment, or so-called open crankcase ventilation (OCV).

An electrical motor 10 is arranged for the rotation of the centrifugal rotor 6*b*. The motor 10 is mounted to the outside of the housing 5, wherein the centrifugal rotor 6*b* comprises a rotor spindle 11 which is drivingly connected to the motor 10. The electrical motor 10 includes control equipment 12 in the form of a variable frequency drive VFD for changing the rotational speed of the electrical motor 10 and thereby of the centrifugal rotor 6*a*. In FIG. 1 the motor 10 and control equipment 12 or VFD are shown as separate parts, but they could of course be integrated into a single unit, wherein the control equipment 12 or VFD is integrated with the electrical motor 10. In the embodiment shown, the VFD is not arranged to change the rotational speed of the centrifugal rotor 6*a* during operation of the combustion engine 3. Accordingly, FIG. 1 is depicted with no communication between the motor 10 and the control equipment 12 or VFD. Although the control equipment 12 of the motor is not used to actively change the rotor speed during operation of the combustion engine 3, a fixed desired rotational speed may still be set, e.g. by an operator, depending on a desired level of separating efficiency, power consumption, rotor suction power etc.

A pressure sensor 13 is arranged to detect a gas pressure in the crankcase, the sensor being arranged to communicate with the control equipment 12 or VFD. This pressure sensor 13 provides a direct measurement of the generated amount of crankcase gas, i.e. there is a direct relationship between the gas pressure and the amount of crankcase gas being produced per unit of time in the crankcase. However, said parameter could also be calculated or measured indirectly by using other sensors, such as an engine speed sensor, a vehicle speed sensor, an engine torque sensor, a throttle position sensor or any combination of these sensors. On a modern vehicle there is usually a computer network which is connected to many different sensors placed in different parts of the vehicle. If the control equipment 12 or VFD is connected to such a computer network, it does not have to be particularly complicated to treat signals coming from different sensors on the vehicle to calculate or indirectly measure the gas pressure in the crankcase or the amount of crankcase gas being produced per unit of time in the crankcase.

As can be seen, the control equipment 12 or VFD is operatively connected to an actuator 14 of a valve 15 which is arranged for adjusting or controlling the flow of gas in the gas inlet 7 of the centrifugal separator 4. In this embodiment, the valve 15 is a butterfly valve arranged in the conduit of the gas inlet 7. The control equipment 12 or VFD is arranged with a regulator, e.g. a PID-regulator, arranged to provide a control of the speed of the electrical motor 10. However, in this embodiment, the regulator is utilized to change the position of the butterfly valve 15 in response to a detected change of crankcase gas pressure. The valve position is changed in a way such that the gas pressure in the crankcase 2 is maintained at a predetermined value, or at a predetermined pressure interval, during operation of the combustion engine 3. For example, if the pressure sensor 13 detects a decrease in the gas pressure of the crankcase, the control equipment 12 or more specifically the regulator of the VFD sends a control signal to the actuator 14 to change the position of the valve 15 towards a more closed position, whereby the gas pressure in the crankcase 2 is increased or rather maintained at the desired gas pressure or at the desired gas pressure interval.

Figure 2:
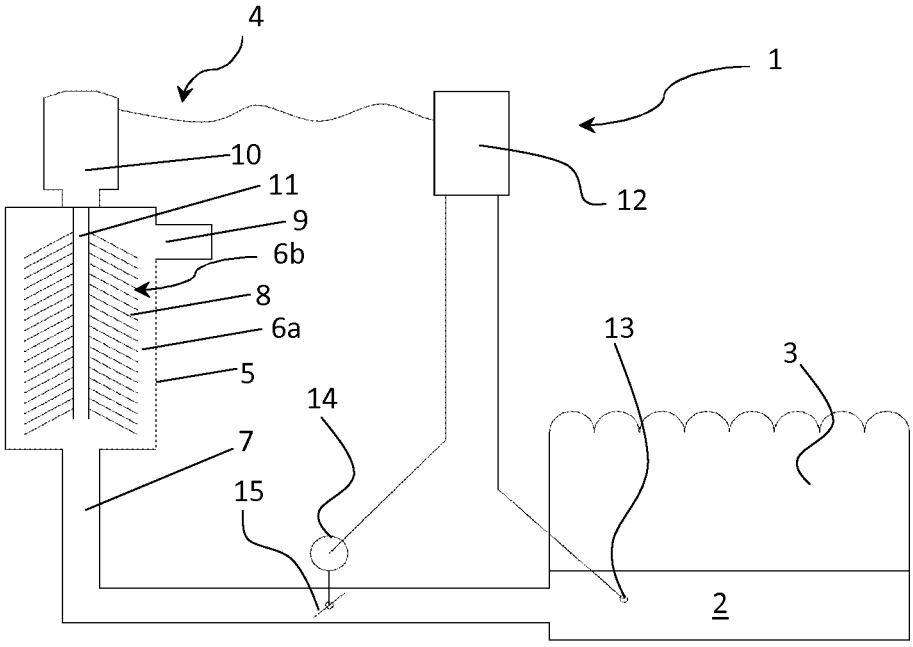
FIG. 2 is a schematic representation of a device according to a second embodiment of the invention.

FIG. 2 discloses a second embodiment of the device 1. It should be noted that corresponding parts of the different embodiments has been given corresponding reference signs. In this second embodiment the control equipment 12 is arranged to change both the position of the valve 15 and the rotational speed of the centrifugal rotor **6*b* in a way such that the gas pressure in the crankcase 2 is maintained at the predetermined value, or at the predetermined pressure interval, during operation of the combustion engine 3. Accordingly, the difference between this embodiment and the first embodiment is that the rotational speed of the centrifugal rotor is also utilized to control the gas pressure in the crankcase. In this embodiment, the control equipment 12 may be programmed with different modes of control. In this case the control equipment 12 is programmed to prioritize the change of the valve position instead of changing the rotational speed of the centrifugal rotor 6*b* in order to maintain the gas pressure in the crankcase 2 during operation of the combustion engine 3. By keeping a (constant) high speed rotation of the centrifugal rotor 6*b*, a high separating efficiency is achieved. The gas pressure in the crankcase 2 may hereby be maintained during "normal" operating conditions of the combustion engine 3 by simply changing the valve position. In special operating conditions the control equipment 12 would however also change the centrifugal rotor speed. The control equipment 12 is hereby programmed to also handle these special operating conditions which may for instance occur during exceptionally high loads and/or speeds of the combustion engine. Abnormal amounts of blow-by or crankcase gas may thereby be generated which in turn increases the gas pressure significantly. In these special situations it may not be enough to simply change valve position to control the gas pressure. The control equipment 12** is furthermore programmed to handle other special operating conditions during an engine start up and/or shut down procedure at which the rotational speed of the centrifugal rotor is adapted to engine speed to maintain the gas pressure.

For this purpose, the control equipment 12 could also include a programmable logic controller or PLC. For example, a first mode of control could be a control by only changing the valve position, a second mode of control could be the combination of changing the valve position and the rotational speed of the rotor, and a third mode of control could be the changing of the valve position or the rotor speed depending on specific operational states of the engine. Said PLC may also be arranged with an input device for a manual setting or selection of desired operational parameters of the device 1, such as upper and lower limits of the desired gas pressure interval in the crankcase 2, the upper and lower limits of the rotational speed of the centrifugal rotor **6*b***, and said different modes of control.

Figure 3:
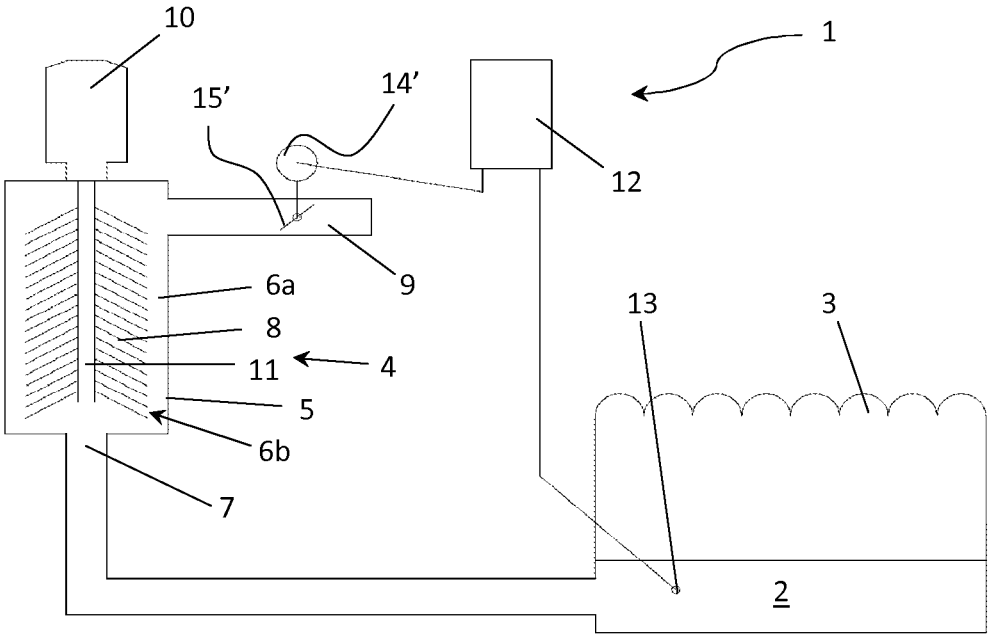
FIG. 3 is a schematic representation of a device according to a third embodiment of the invention.

FIG. 3 discloses a third embodiment of the device 1. As can be seen, a valve 15' is arranged in the gas outlet 9 of the device 1. Consequently, the gas pressure in the crankcase may also be controlled by changing the position of a valve 15' disposed downstream of the centrifugal rotor **6*b*. The control equipment 12 or VFD is operatively connected to an actuator 14' of the valve 15' which is arranged for adjusting or controlling the flow of gas in the gas outlet 9 of the centrifugal separator 4. Furthermore, as in the first embodiment, the valve 15 is a butterfly valve. However, an advantage of this embodiment is that the valve 15' will not be as contaminated during operation of the combustion engine, since it's placed in the gas outlet 9. The previous second embodiment could be modified with this embodiment, i.e. the second embodiment the valve 15 could be placed in the gas outlet 9 instead of the gas inlet 7**.

The invention is not limited to the embodiments disclosed but may be varied and modified within the scope of the claims set out below. The motor shown is an electrical motor, but this could for example be a hydraulic or pneumatic motor with control equipment for changing the rotational speed of the motor. The butterfly valve shown could of course also be replaced by any type of valve adapted to provide a variable throttling of the gas flow through the separator.

The invention claimed is:

1. A device for cleaning of crankcase gas being produced in a crankcase during operation of an internal combustion engine, said device comprising a centrifugal separator comprising a housing delimiting a separation chamber in which a centrifugal rotor is arranged for cleaning of said crankcase gas, wherein the centrifugal separator is connected to a gas inlet for conducting a flow of crankcase gas from the crankcase to the centrifugal separator and a gas outlet for conducting the flow of gas from the centrifugal separator, and the centrifugal rotor comprises a plurality of truncated conical separation discs configured to separate contaminants from the gas;

a motor which is arranged to rotate the centrifugal rotor, the motor being arranged with control equipment for changing a rotational speed of the motor and thereby of the centrifugal rotor;

a sensor for detection of a gas pressure in the crankcase, the sensor being arranged to communicate with the control equipment of the motor;

the control equipment is operatively connected to a valve which is arranged for adjusting the flow of gas through the centrifugal separator, wherein the control equipment is arranged to change the position of the valve in response to a detected change of said gas pressure in the crankcase, detected by the sensor, so that the gas pressure in the crankcase is maintained at a predetermined value, or at a predetermined pressure interval, during operation of the combustion engine;

the control equipment being configured to coordinate adjustment of the rotational speed of the centrifugal rotor and the position of the valve to maintain a predetermined separation efficiency of the centrifugal separator; and the control equipment is arranged to change of the valve position before changing the rotational speed of the centrifugal rotor to maintain the gas pressure in the crankcase during operation of the combustion engine.

2. A device according to claim 1, in which the valve is arranged in the gas inlet.

3. A device according to claim 1, in which the valve is arranged in the gas outlet.

4. A device according claim 1, in which the control equipment is arranged to change both the position of the valve and the rotational speed of the centrifugal rotor in a way such that the gas pressure in the crankcase is maintained at the predetermined value, or at the predetermined pressure interval, during operation of the combustion engine.

5. A device according to claim 4, in which the centrifugal rotor is arranged by its rotation to suck crankcase gas from the crankcase to the centrifugal separator.

6. A device according claim 1, in which the motor is an electrical motor with control equipment in the form of a variable frequency drive (VFD) having an in-built regulator which is operatively connected to the valve.

7. A device according to claim 1, in which the control equipment includes a programmable logic controller (PLC).

8. A device according to claim 7, in which the programmable logic controller (PLC) is arranged with an input device for setting desired operational parameters of the device.

9. A method for cleaning crankcase gas being produced in a crankcase during operation of an internal combustion engine, wherein a centrifugal rotor of a centrifugal separator is kept rotating in a separation chamber inside a housing for the cleaning of the crankcase gas, the centrifugal rotor being rotated by a motor having control equipment for changing the rotational speed of the motor and thereby of the centrifugal rotor, a flow of crankcase gas being conducted to the centrifugal separator through a gas inlet and the flow of gas being conducted from the centrifugal separator through a gas outlet, the centrifugal rotor comprises a plurality of truncated conical separation discs configured to separate contaminants from the gas;

a sensor is detecting a gas pressure in the crankcase, the sensor communicating with the control equipment of the motor; and the control equipment is communicating with a valve for adjusting the flow of gas through the centrifugal separator, the control equipment causing the valve to change position in response to a detected change of said gas pressure in the crankcase, detected by the sensor, in a way such that the gas pressure in the crankcase is maintained at a predetermined value, or at a predetermined pressure interval, during the operation of the combustion engine;

the control equipment changing both the position of the valve and the rotational speed of the centrifugal rotor so that the gas pressure in the crankcase is maintained at the predetermined value, or at the predetermined pressure interval, during the operation of the combustion engine;

the control equipment coordinating adjustment of the rotational speed of the centrifugal rotor and the position of the valve to maintain a predetermined separation efficiency of the centrifugal separator; and the control equipment changing of the valve position before changing the rotational speed of the centrifugal rotor to maintain the gas pressure in the crankcase during operation of the combustion engine.

10. A method according to claim 9, in which the centrifugal rotor during its rotation is sucking crankcase gas from the crankcase to the centrifugal separator.

11. A method according to claim 9, in which a variable frequency drive (VFD) having an in-built regulator is used as the control equipment for an electrical motor, wherein the regulator communicates with the valve.

12. A method according to any one of claim 9, in which a programmable logic controller (PLC) is used with the control equipment.

13. A method according to claim 12, in which the programmable logic controller (PLC) communicates with an input device for setting desired operational parameters of the device.

14. The method of claim 9 wherein the internal combustion engine is of a locomotive or a ship.

15. The method of claim 9 wherein the internal combustion engine is of a power plant.

* * * * *